US007780043B2

(12) United States Patent
Jourdin et al.

(10) Patent No.: US 7,780,043 B2
(45) Date of Patent: Aug. 24, 2010

(54) FASTENER DEVICE FOR FASTENING A PUMP OR A VALVE ONTO A RECEPTACLE NECK AND A FLUID DISPENSER INCLUDING SUCH A FASTENER DEVICE

(75) Inventors: Gilles Jourdin, Combon (FR); Patrick Muller, Villez/Bailleul (FR); Bruno Stuart, Poses (FR)

(73) Assignee: Valois S.A.S, Le Neubourg (FR)

( * ) Notice: Subject to any disclaimer, the term of this patent is extended or adjusted under 35 U.S.C. 154(b) by 1137 days.

(21) Appl. No.: 11/410,032

(22) Filed: Apr. 25, 2006

(65) Prior Publication Data

US 2006/0283830 A1 Dec. 21, 2006

Related U.S. Application Data

(60) Provisional application No. 60/695,000, filed on Jun. 30, 2005.

(30) Foreign Application Priority Data

Apr. 25, 2005 (FR) ..... 05 51067

(51) Int. Cl.
*B65D 45/00* (2006.01)

(52) U.S. Cl. ..... 222/321.9; 222/153.01; 215/273

(58) Field of Classification Search ..... 222/321.7, 222/321.8, 321.9, 153.01, 153.02, 153.11; 215/273, 274, 277, 280
See application file for complete search history.

(56) References Cited

U.S. PATENT DOCUMENTS

| | | | | |
|---|---|---|---|---|
| 5,277,334 | A * | 1/1994 | Malinconico | 222/36 |
| 7,011,236 | B2 * | 3/2006 | VanBrocklin | 222/321.9 |
| 2003/0150876 | A1 * | 8/2003 | Walters et al. | 222/153.13 |

FOREIGN PATENT DOCUMENTS

| | | |
|---|---|---|
| EP | 1 270 434 A | 1/2003 |
| FR | 2 776 989 A | 10/1999 |

* cited by examiner

*Primary Examiner*—J. Casimer Jacyna
(74) *Attorney, Agent, or Firm*—Sughrue Mion, PLLC

(57) ABSTRACT

A fastener device for fastening a dispenser member (4), such as a pump or a valve, onto a receptacle neck (31). The device includes a fastener ring (1) including both an abutment (13) and a fastener (12) for fastening onto the receptacle neck; and a covering hoop (2) that is engaged axially from top to bottom around the ring (1). The hoop includes a hook (25) co-operating with the abutment for acting together to axial retain the hoop on the ring. The retention mechanism includes a plurality of mutual engagement elements defining distinct axial engagement positions for engaging the hoop on the ring.

15 Claims, 4 Drawing Sheets

FASTENER DEVICE FOR FASTENING A PUMP OR A VALVE ONTO A RECEPTACLE NECK AND A FLUID DISPENSER INCLUDING SUCH A FASTENER DEVICE

CROSS REFERENCE TO RELATED APPLICATION

This application claims the benefit under 35 U.S.C. §119 (e) of pending U.S. provisional patent application Ser. No. 60/695,000, filed Jun. 30, 2005, and priority under 35 U.S.C. §119(a)-(d) of French patent application No. FR-05.51067, filed Apr. 25, 2005.

TECHNICAL FIELD

The present invention relates to a fastener device for fastening a dispenser member, such as a pump or a valve, onto a receptacle neck. The invention also relates to a fluid dispenser comprising a receptacle, a dispenser member such as a pump or a valve, and a fastener device of the invention.

BACKGROUND OF THE INVENTION

In numerous technical fields, such as the fields of perfumery, cosmetics, or even pharmacy, for example, it is known to use a fluid dispenser in the form of a receptacle associated with a pump or a valve fastened on the opening of the receptacle. By actuating the pump or the valve, fluid is dispensed, optionally in measured out quantities or "doses". In that type of fluid dispenser, it is essential for the pump or the valve to be fastened in stable and leaktight manner on the opening of the receptacle. To do that, a fastener device is conventionally used which holds the pump or the valve, and which is provided with fastener means for fastening onto the opening of the receptacle. The fastener means can use various techniques, such as screw-engagement, clamping, adhesive, or even snap-fastening or hook-engagement techniques.

A well known embodiment for a fastener device uses a fastener ring comprising fastener means for fastening onto the receptacle neck, and a covering hoop that is engaged axially from top to bottom around the ring. In the present invention, the covering hoop includes hook means co-operating with abutment means formed by the ring for acting together to define axial retainer means for retaining the hoop on the ring. Document EP 1 270 434 describes a fastener device of that type in which the bottom end of the hoop is upturned inwards so as to define an upwardly-directed inner shoulder. The inner shoulder is designed to become engaged below the fastener ring which forms abutment means at this location. In that prior-art document, the axial retainer means for retaining the hoop on the ring are therefore defined by the inner shoulder of the upturned end of the hoop co-operating with the bottom end of the ring, or more precisely with the end edge of the fastener ring. The inner shoulder of the hoop is perfectly annular, so as to define a circle that extends in a single plane. The same applies for the bottom end of the fastener ring, which also defines a circle extending in a single plane. Thus, the engagement of the inner shoulder just below the bottom end of the ring defines a single axial blocking position for the hoop on the ring. Consequently, the engagement or axial abutment of the hoop relative to the ring is imposed by the inner shoulder of the hoop and by the bottom end of the fastener ring, which both extend in planes that coincide while the shoulder comes into abutment contact with the ring.

The drawback with the fastener device of document EP 1 270 434 is that there is no freedom or modularity in axially positioning the hoop relative to the ring. It is sometimes useful for the hoop to be disposed axially relative to the ring as a function of the configuration of the receptacle on which the fastener device is to be mounted. More precisely, the bottom end of the hoop must generally come to bear against the receptacle, so as to create a sort of continuity between the receptacle and the fastener device. Consequently, it is sometimes necessary to push the hoop onto the ring to a greater or lesser extent, which amounts to modifying the axial position of the hoop on the ring.

BRIEF SUMMARY OF THE INVENTION

An object of the present invention is to remedy the above-mentioned drawback of the prior art by defining a fastener device having a covering hoop that can be positioned and blocked relative to the ring in distinct axial positions.

To achieve this object, the present invention proposes a fastener device for fastening a dispenser member, such as a pump or a valve, onto a receptacle neck, the device comprising:

- a fastener ring including both abutment means and fastener means for fastening onto the receptacle neck; and
- a covering hoop that is engaged axially from top to bottom around the ring, the hoop including hook means co-operating with the abutment means for acting together to define axial retainer means for retaining the hoop on the ring;

said device being characterized in that the retainer means include a plurality of mutual engagement elements defining distinct axial engagement positions for engaging the hoop on the ring. As in the above-mentioned prior-art document, the covering hoop is still hooked onto the ring, but this hook-engagement can take place at various axially-offset locations. The mutual engagement elements enabling the hook-engagement to be offset axially can be formed either by the hoop, or by the ring, or by both of them.

In an advantageous embodiment, the hoop includes a top end, and a bottom end for coming to bear on the receptacle, the hook means being formed by an upwardly-directed inner shoulder that is advantageously defined in the proximity of the bottom end. The inner shoulder is advantageously formed by the hoop being upturned inwards at its bottom end.

According to another aspect of the invention, the abutment means include at least one downwardly-directed abutment zone.

In a first practical embodiment, a plurality of abutment zones are provided, disposed in various axial positions, the various abutment zones defining engagement teeth. The fastener ring advantageously includes a substantially cylindrical skirt that is engaged around the neck, the skirt defining an outer wall including a plurality of axially offset abutment zones. The abutment zones are preferably formed by the downwardly-directed bottom ends of longitudinal axial splines which extend vertically while projecting radially from the outer wall of the skirt, the bottom ends of the splines being situated in axially-offset positions.

In another advantageous embodiment, the shoulder of the hoop presents a crenellated profile defining axially-offset engagement elements. The crenellated profile advantageously defines crenellations of various heights and/or depths.

It should be noted that both embodiments can be implemented cumulatively in the same fastener device. However, it is preferable to implement them separately. It should also be noted that the axially-offset engagement elements, whether they are formed by the hoop or by the ring, do not create production or manufacturing difficulties compared with the fastener device of document EP 1 270 434. Crenellating the upturned portion of the hoop is very easy to achieve. No technical difficulty is encountered when molding the splines on the skirt.

According to another advantageous characteristic of the invention, the ring includes a projecting pre-assembly collar with which the hook means of the hoop become engaged in the pre-assembled position. The pre-assembly position, in which the hoop is not completely engaged on the ring, is useful in particular while transporting, storing, and handling the fastener device. The projecting collar enables the hoop to be held on the ring, so that together they form only a single unit that cannot be dismantled. While the fastener device is being put in place on a receptacle, the ring and the hoop can be manipulated as if they were a single part only. As soon as the fastener ring has been mounted on the neck of the receptacle, the already pre-assembled covering hoop can be pushed down axially onto the ring, so as to block it in engagement around the neck.

The invention also defines a fluid dispenser comprising a receptacle, a dispenser member such as a pump or a valve, and a fastener device as defined above.

BRIEF DESCRIPTION OF THE DRAWINGS

The invention is described more fully below with reference to the accompanying drawings which show two embodiments of the invention by way of non-limiting example.

In the figures.

DETAILED DESCRIPTION

Figure 2:
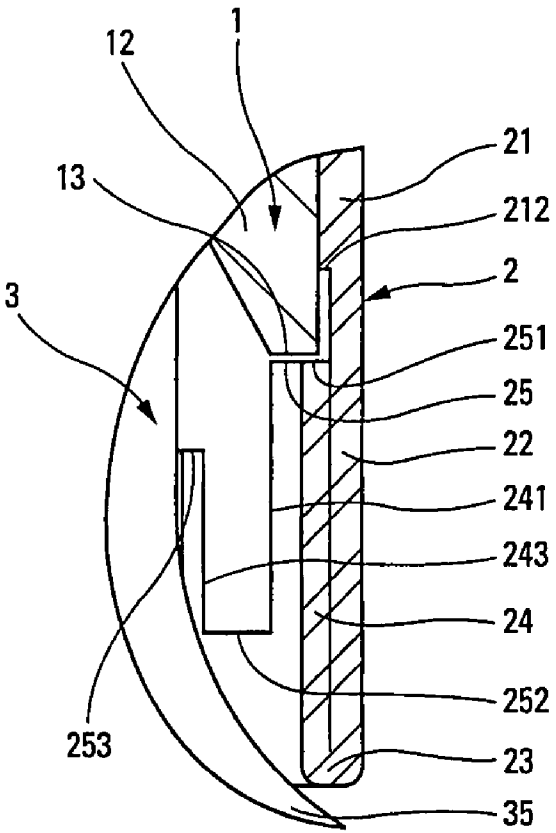
FIG. 2 is a larger-scale view of a detail of FIG. 1.

In the two embodiments shown in the figures, the fastener device of the invention is associated with a dispenser member, specifically a pump 4. However, a valve could very well be used instead of the pump. In addition, the fastener device associated with the pump is mounted on a receptacle 3 which defines an opening, advantageously in the form of a neck 31. The neck 31 extends upwards from the body of the receptacle, which forms a shoulder 35 in its top portion. The neck 31 therefore projects from the shoulder 35. The neck 31 includes an outer peripheral reinforcement forming a downwardly-directed rim 32. In conventional manner, the rim 32 serves to fasten the fastener device, as described below. The neck 31 also includes a top annular edge 33, and an inner wall 34 which defines the opening of the receptacle. In the fields of perfumery, cosmetics, or even pharmacy, this is a fairly conventional design for a receptacle serving to contain a fluid. The receptacle can be made out of any appropriate material, such as glass, plastics material, or metal, for example.

The dispenser member, designated overall by the numerical reference 4, includes a body 41 provided with a holding collar 42 at its top end. The dispenser member 4 also includes an actuator rod 43 which moves up and down against a return spring inside the body 41. In the fields of pharmacy, perfumery, or cosmetics, this is a fairly conventional design for a pump or a valve.

The fastener device serves to fasten or to hold the dispenser member 4 in the opening of the neck 31, with the actuator rod 43 projecting upwards from the neck. Once in place, the dispenser member receives a dispenser head which is mounted on the free top end of the actuator rod 43, but this is not shown. Advantageously, the dispenser member 4 can also be provided with a dip tube which extends inside the receptacle 3 so as to withdraw the fluid.

In both of the embodiments shown in the figures, the fastener device comprises two component elements, namely a fastener ring 1 and a covering hoop 2.

In both of the embodiments in the figures, the fastener ring 1 includes a substantially cylindrical peripheral skirt 11 which is provided on its inside with fastener means 12 which can be in the form of a continuous snap-fastener bead, or in the form of individual snap-fastener heads. The fastener means 12 project radially inwards from the inner wall of the skirt 11. The fastener means 12 are designed to become engaged below the rim 32 formed by the neck 31 of the receptacle 3, as can be seen very clearly in FIGS. 1 and 6. In the first embodiment in FIGS. 1 to 5, the skirt 11 is continuous so that the fastener means 12 can be in the form of a continuous inner annular bead. The fastener ring is thus mounted on the receptacle neck by force-fitting, so as to cause the continuous bead 12 to pass by force below the rim 32 formed by the peripheral outer rim of the neck. In contrast, in the second embodiment in FIGS. 6 to 8, the skirt 11 is discontinuous, and is thus in the form of skirt segments that are separated by longitudinal vertical slots 111. This is merely a variant embodiment: the skirts in both embodiments could be continuous or slotted.

The skirt 11 extends downwards from an annular flat 15 which serves to compress a neck gasket 5 against the top annular end 33 of the neck. The gasket 5 is compressed by the traction exerted by the skirt 11 having fastener means 12 that are constrained to be received below the rim 32. In the fields of cosmetics, perfumery, or pharmacy, this is also a fairly conventional design for a fastener ring.

Beyond the annular flat 15, the fastener ring forms a reception housing 17 in which the collar 42 formed by the body 41 of the dispenser member 4 is received. The collar 42 can be received by snap-fastening, for example. The snap-fastening housing 17 also forms a central passage 18 through which the actuator rod 43 extends.

This general design for the fastener ring is common to both of the embodiments. It enables the dispenser member 4 to be held on the neck 31 in secure and effective manner. When the skirt 11 is continuous, fastening can be ensured by the ring on its own. In contrast, when the skirt is slotted, permanent fastening is obtained by putting the covering hoop in place, as described below. The present invention applies to both configurations, namely a continuous skirt or a slotted skirt.

In both embodiments, the hoop 2 includes a substantially cylindrical body 21 which is extended at its top end by an inwardly-directed rim 26 which defines a large through hole. At its opposite, bottom end, the hoop 2 includes a thin portion 22 having wall thickness that is less than the thickness of the main portion of the body 21. The difference in wall thickness between the body 21 and the thin portion 22 is visible in the form of an inner step 212 which extends over the entire inner periphery of the hoop.

The bottom end of the hoop is formed by an edge 23 which results from inwardly turning-up a portion 24 of the hoop. The upturned portion 24, which originally extended in line with the thin portion 22, is upturned inwards by using a well-known turning-up method. The bottom edge 23 thus forms the junction between the thin portion 22 and the upturned inner portion 24. The free end of the upturned portion 24 forms a shoulder 25 that is directed upwards, i.e. towards the inwardly-directed rim 26.

Thus, the shoulder 25 substantially faces the step 212, as can be seen in FIG. 2. An annular housing is thus created in the inner wall of the hoop between the step 212 and the shoulder 25. This design for the covering hoop is common to both of the embodiments.

Figure 1:
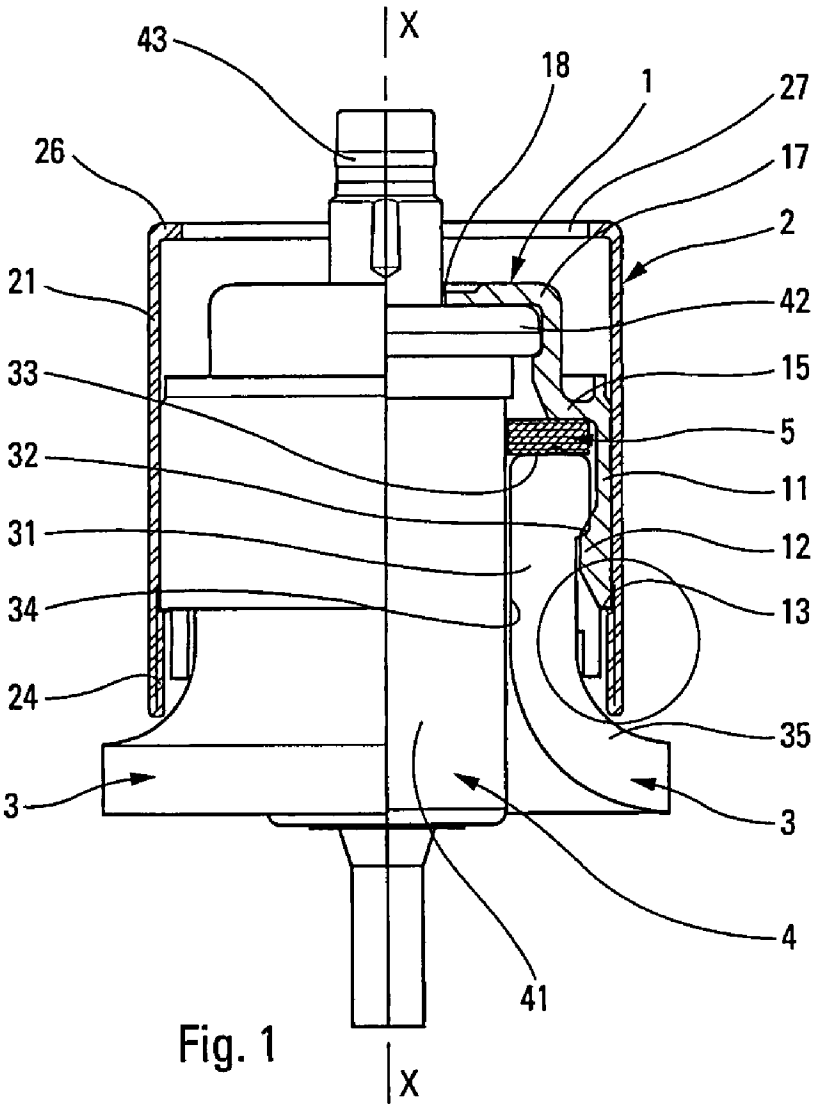
FIG. 1 is a view partially in vertical section of a fastener device constituting a first embodiment of the invention in its assembled state on a receptacle neck.
Figure 6:
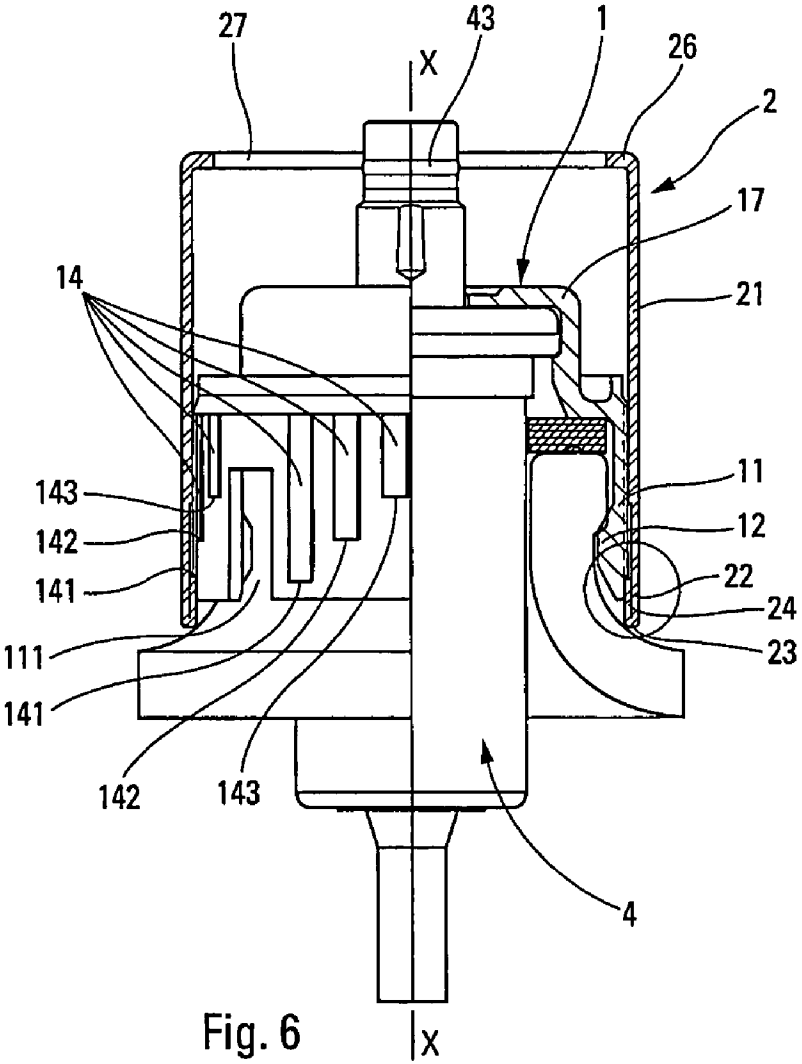
FIG. 6 is a view similar to the FIG. 1 view showing a second embodiment of a fastener device of the invention.

The fastener ring 1, the hoop 2, the receptacle neck 31, and the dispenser member 4 all present a certain amount of longitudinal axial symmetry along an axis X that is visible in FIGS. 1 and 6. While the dispenser made up of these elements is being assembled, firstly the dispenser member 4 is engaged axially, via the bottom, inside the reception housing 17 formed by the ring 1. Then, the ring 1 with its snap-fastened dispenser member 4 is brought axially onto the receptacle neck 31 via the top, until its fastener means 12 become engaged below the rim 32. Finally, the covering hoop 2 is brought axially onto the fastener ring 1 from top to bottom, so as to become engaged with the outer wall of the skirt 11. In the final position, shown in FIGS. 1 and 6, the bottom end or bottom edge 23 of the hoop 2 comes to bear against, or in the proximity of, the shoulder 35 formed by the receptacle 3. For reasons of appearance, it is desirable for the hoop to come into contact with the shoulder 35. In the final position, the fastener ring 1 is no longer even visible, given that the actuator rod 43 is covered by the dispenser head which surrounds the hoop 2 or becomes housed inside the hoop 2.

In both of the embodiments, the shoulder 25 of the upturned portion 24 forms hook means that co-operate with abutment means formed by the ring 1. By way of example, the abutment means can be formed by the bottom end 13 of the skirt 11. The hook means and the abutment means co-operate with each other to form axial retainer means that enable the hoop to be blocked on the ring. It is thus no longer possible to remove the hoop from the ring, thereby implying that the ring 1 can no longer be removed from the receptacle neck. Thus, the dispenser member 4 is fastened onto the receptacle neck in permanent and tamperproof manner.

In the invention, the axial retainer means for retaining the hoop on the ring enable the hoop to be disposed on the ring in a plurality of distinct axially-offset positions. In other words, the hoop 2 can be engaged on the ring with its bottom edge 23 extending downwards to a greater or lesser extent from the bottom end of the skirt 11. This enables the hoop to be disposed and blocked on the ring with the bottom edge 23 of the hoop in contact with the shoulder 35 of the receptacle 3, whatever the height of the neck 31. The axial retainer means thus include a plurality of mutual engagement elements which define distinct axial engagement positions for engaging the hoop on the ring. The engagement elements can be formed either by the hoop, or by the ring. The engagement elements make it possible to define determined axial blocking positions for blocking the hoop relative to the ring as a function of the shape of the receptacle neck.

Figure 5:
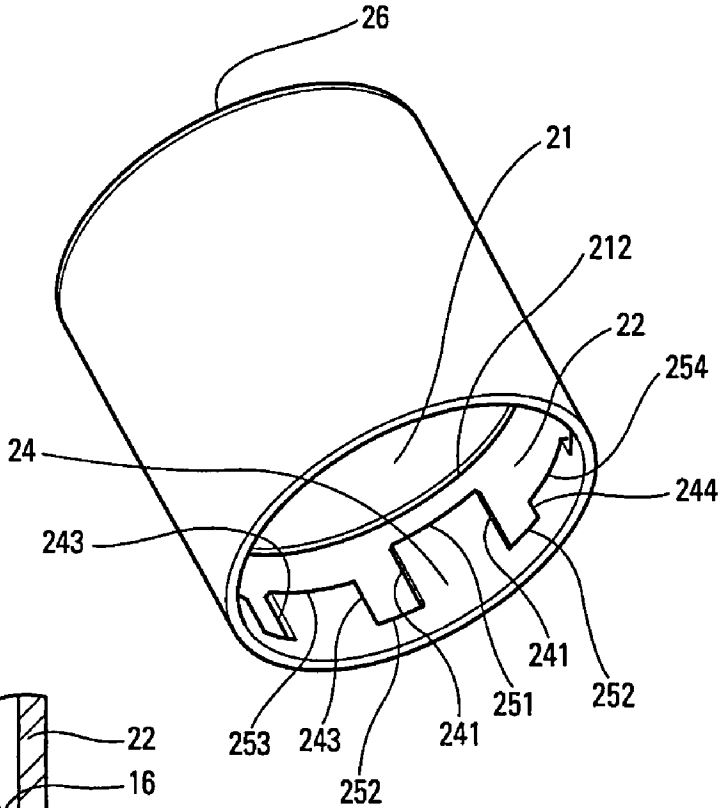
FIG. 5 is a perspective view of the hoop of the fastener device constituting the first embodiment of the invention.

With reference to the first embodiment in FIGS. 1 to 5, it can be seen that the mutual engagement elements are formed by the covering hoop 2. The shoulder 25 of the upturned portion 24 of the covering hoop presents a crenellated profile, thus defining crenellations of various heights and depths. With reference to FIG. 5, it can be seen that the upturned portion 24 defines three crenellation tips 251, 253, and 254 that are separated by crenellation troughs 252 that are situated at the same axial height. In contrast, the crenellation tips 251, 253, and 254 are situated at different axial heights. The crenellation tips and the crenellation troughs define segments of an arc of a circle which are connected by radial segments 241, 243, and 244 of varying heights. In this embodiment, the shoulder 25 formed by the upturned portion 24 defines four mutual engagement elements formed by the crenellation tips 251, 253, 254, and by the crenellation troughs 252. Each of the engagement elements is adapted to come into abutment against the bottom end 13 of the skirt 11, as can be seen in FIG. 2 with the crenellation tip 251. If the receptacle neck had been made shorter or more squat, the shoulder 25 would have been situated a little higher, and the crenellation tip 251 could not therefore have come into abutment below the end 13. In contrast, the other crenellation tip 253 would therefore have fulfilled the hook-engagement abutment function below the bottom end 13. However, if the neck was even more squat, the crenellation trough 252 would come into abutment below the bottom end 13. It can thus be seen that the covering hoop 2 can become hooked below the ring 1 in various different axially-offset positions. This enables the hoop to be hooked below the ring whatever the shape of the receptacle neck. Instead of the bottom end 13 of the skirt 11, it is possible to provide some other abutment zone formed by the ring 1.

The bottom end 13 can come into abutment against the crenellations as a result of the ring, made of plastics material, always tending to deform or creep outwards.

Figure 4:
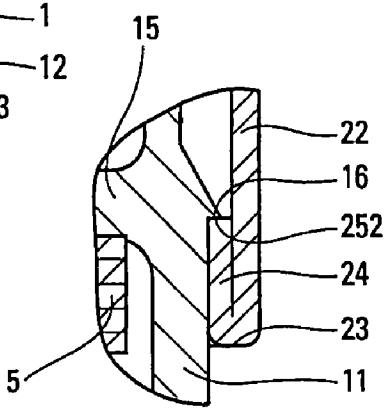
FIG. 4 is a larger-scale view of a detail of FIG. 3.
Figure 3:
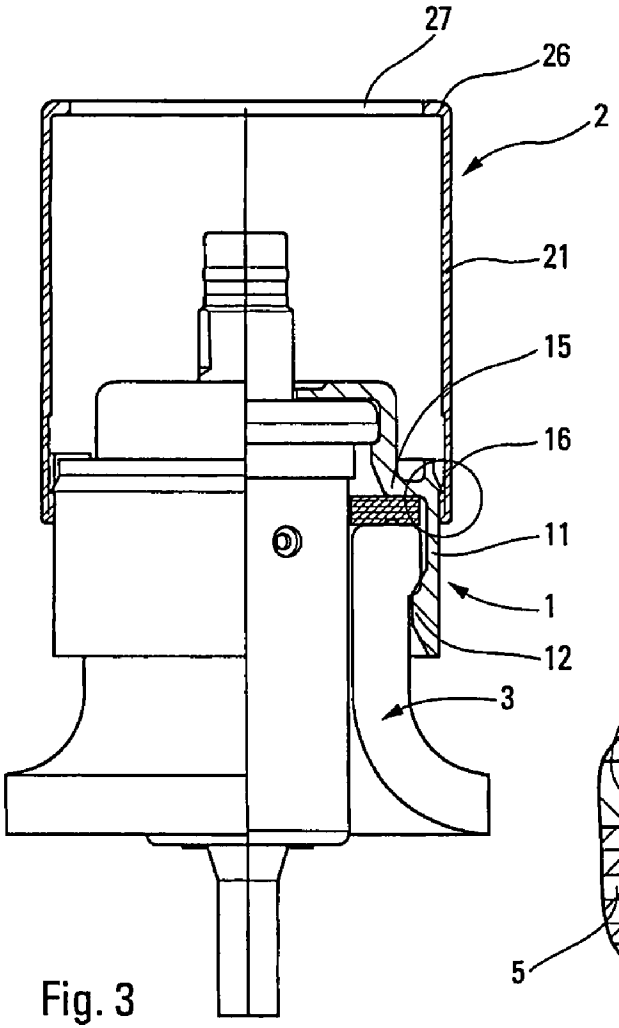
FIG. 3 is a view similar to the FIG. 1 view, with the fastener device in its pre-assembled state on a receptacle neck.

With reference to FIGS. 3 and 4, it can be seen that the fastener ring 1 is also provided with a projecting peripheral pre-assembly collar 16 which projects radially outwards level with the flat 15 at the top end of the skirt 11. The collar 16 also serves to enable the covering hoop 2 to be hooked thereon, while said covering hoop is not yet permanently engaged around the skirt 11. In the pre-assembly position shown in FIGS. 3 and 4, the fastener ring 1 can be mounted on a receptacle neck, since the skirt 11 is not yet prevented from deforming radially outwards by the engagement of the covering hoop 2. In contrast, the covering hoop 2 is secured to the fastener ring 1, and, together with the ring, constitutes a single unit that cannot be dismantled. This is particularly advantageous for transporting, storing, and handling the fastener ring and the covering hoop associated therewith. The projecting collar 16 can become engaged with the shoulder 25 formed by the upturned portion 24, or more precisely with any crenellation formed by the crenellated profile of the shoulder. In FIGS. 3 and 4, it is the crenellation trough 252 that is engaged with the projecting collar 16.

Figure 7:
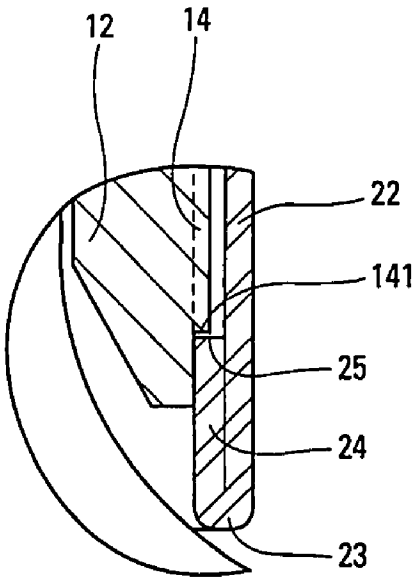
FIG. 7 is a larger-scale view of a detail of FIG. 6.
Figure 8:
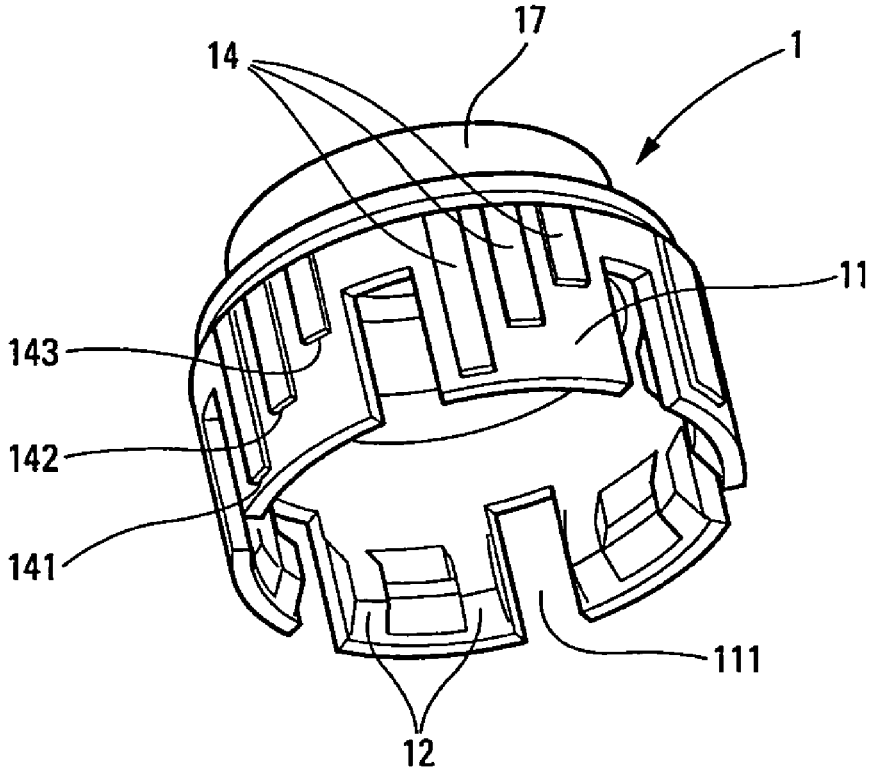
FIG. 8 is a perspective view of the fastener ring of the fastener device constituting the second embodiment of the invention.

Reference is made below to FIGS. 6 to 8 in order to explain the second embodiment of the invention. The covering hoop 2 can be identical to the covering hoop of the first embodiment, or, in a variant, the upturned portion 24 of the hoop can present a continuous inner shoulder 25, i.e. without a crenellated profile. In contrast, the skirt 11, which in this embodiment is slotted, is provided with a plurality of series of longitudinal vertical splines 14 that extend downwards from the projecting collar 16. In this embodiment, each series of splines comprises three splines of different heights. Naturally, it is possible to provide any number of splines in a series, and any number of series. Given that in this embodiment the fastener ring includes six skirt segments separated by six slots 111, the ring is provided with six series each of three splines of different heights. The splines define bottom abutment ends 141, 142, and 143 that are disposed at various axially-offset heights. Each spline end thus defines downwardly-directed abutment means, i.e. abutment means that are directed towards the shoulder 25 of the upturned portion 24 that extends upwards. With reference to FIG. 7, it can be seen that the shoulder 25 is received just below the abutment end 141 of the longest spline. As with the crenellated profile of the first embodiment, the series of splines of different heights constitute mutual engagement elements enabling the hoop to be disposed and blocked relative to the ring in axially-offset positions. By engaging the shoulder 25 with the abutment end 143 of the shortest spline, the covering hoop 2 is not pushed down as far onto the ring.

As in the first embodiment, the shoulder 25 of the upturned portion 24 can become engaged below the projecting collar 16 so as to preposition the covering hoop 2 on the fastener ring.

Figure 9:
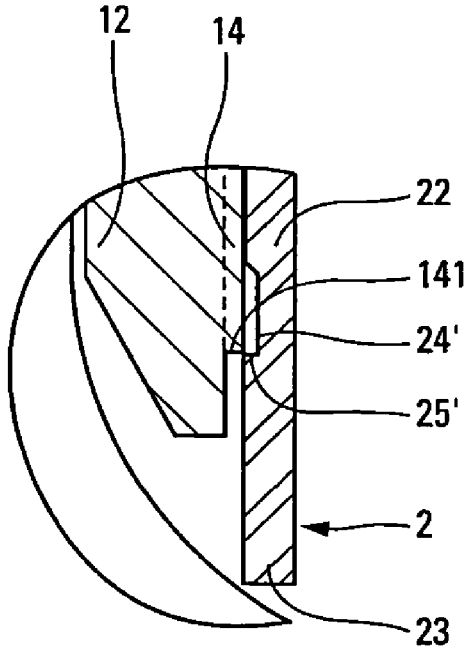
FIG. 9 is a view similar to the FIG. 7 view showing a variant embodiment of the hoop.

FIG. 9 shows a variant embodiment for the hoop 2, in which it does not have an upturned portion 24, but forms an inner peripheral recess 24' that defines a bottom abutment edge 25' which can fulfill the same function as the shoulder 25. The abutment zone formed by the ring can thus come into abutment against the bottom edge. The hoop need not have a greater wall thickness below the bottom edge, since the abutment zone formed by the ring will creep into the recess as a result of the creep properties of the plastics material constituting the ring.

In a variant, it can also be envisaged to form the retainer means at the top portion of the skirt and of the hoop.

The ring is preferably made out of plastics material, and the hoop can be made out of metal or out of plastics material.

It should also be observed that the hoop can become engaged with the ring at a location other than its free bottom end.

In all of the embodiments, the covering hoop 2 is hooked and locked in axial positions that can vary, e.g. as a function of the shape of the receptacle neck.

The invention claimed is:

1. A fastener device for fastening a dispenser member (4) onto a receptacle neck (31), the device comprising:

a fastener ring (1) including both abutment means (13; 141, 142, 143) and fastener means (12) for fastening onto the receptacle neck; and a covering hoop (2) that is engaged axially from top to bottom around the ring (1), the hoop including hook means (25) co-operating with the abutment means for acting together to define axial retainer means for axially blocking the hoop on the ring;

wherein the retainer means include a plurality of mutual engagement elements (251, 252, 253, 254; 13; 25, 141, 142, 143) defining distinct axial engagement positions for engaging the hoop on the ring; and the hoop includes a top end and a bottom end for coming to bear on the receptacle, the hook means being formed by an upwardly-directed inner shoulder that is defined in the proximity of the bottom end.

2. A fastener device according to claim 1, in which the inner shoulder (25) is formed by the hoop being upturned inwards at its bottom end.

3. A fastener device according to claim 1, in which the abutment means include at least one downwardly-directed abutment zone.

4. A fastener device according to claim 3, in which a plurality of abutment zones (141, 142, 143) are provided, disposed in various axial positions, the various abutment zones defining engagement elements.

5. A fastener device according to claim 4, in which the fastener ring includes a substantially cylindrical skirt (11) that is engaged around the neck (31), the skirt defining an outer wall including a plurality of axially-offset abutment zones (141, 142, 143).

6. A fastener device according to claim 5, in which the abutment zones are formed by the downwardly-directed bottom ends (141, 142, 143) of longitudinal axial splines (14) which extend vertically while projecting radially from the outer wall of the skirt, the bottom ends of the splines being situated in axially-offset positions.

7. A fastener device according to claim 1, in which the shoulder (25) of the hoop (2) presents a crenellated profile defining axially-offset engagement elements.

8. A fastener device according to claim 7, in which the crenellated profile defines crenellations (251, 252, 253, 254) of various heights or depths.

9. A fastener device according to claim 1, in which the ring includes a projecting pre-assembly collar (16) with which the hook means (25) of the hoop become engaged in the pre-assembled position.

10. A fluid dispenser comprising a receptacle, a dispenser member and a fastener device according to claim 1.

11. The fastener device according to claim 1, wherein the dispenser is a pump or a valve.

12. A fastener device for fastening a dispenser member onto a receptacle neck, the device comprising:

a fastener ring defining a center axis and comprising a radially inwardly extending protrusion configured to engage below a rim of the receptacle neck and one or more first abutment faces; and a covering hoop that covers and engages around at least an outside portion of the ring, the hoop comprising a radially inwardly protruding hook with one or more second abutment faces that abut with the one or more first abutment faces so as to form a plurality of abutments that axially retain the hoop on the ring and prevent the hoop from being axially removed from the ring; and wherein the abutments include at least two abutments that are located at different axial distances from a bottom distal end of the hoop; and wherein each of the one or more second abutment faces is an upwardly-directed inner shoulder formed by the hoop being upturned inwards at the bottom distal end of the hoop.

13. The fastener according to claim 12, wherein each of the one or more first abutment faces is a downwardly-directed face extending from the ring radially outwardly.

14. A fastener device for fastening a dispenser member (4) onto a receptacle neck (31), the device comprising:

a fastener ring including both abutment means and fastener means for fastening onto the receptacle neck; and a covering hoop that is engaged axially from top to bottom around the ring, the hoop including hook means co-operating with the abutment means for acting together to define axial retainer means for retaining the hoop on the ring;

wherein the retainer means include a plurality of mutual engagement elements defining distinct axial engagement positions for engaging the hoop on the ring; and wherein the hoop includes a top end, and a bottom end for coming to bear on the receptacle, the hook means being formed by an upwardly-directed inner shoulder that is defined in the proximity of the bottom end.

15. The fastener device according to claim 14, wherein the inner shoulder is formed by the hoop being upturned inwards at its bottom end.

* * * * *